US006923336B2

(12) United States Patent
Lin

(10) Patent No.: US 6,923,336 B2
(45) Date of Patent: Aug. 2, 2005

(54) GAS CONTAINER

(76) Inventor: Arlo Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 76 days.

(21) Appl. No.: 10/619,800

(22) Filed: Jul. 14, 2003

(65) Prior Publication Data

US 2005/0013511 A1 Jan. 20, 2005

(51) Int. Cl.[7] ..... B65D 90/00
(52) U.S. Cl. ..... 220/495.07; 383/3
(58) Field of Search ..... 220/495.07, 495.11; 383/3, 63, 108, 109, 44; 347/86

(56) References Cited

U.S. PATENT DOCUMENTS 4,363,841 A * 12/1982 Snow ..... 383/108
4,516,977 A * 5/1985 Herbert ..... 604/415
4,892,604 A * 1/1990 Measells et al. ..... 156/244.24
6,127,009 A * 10/2000 Strassmann ..... 428/35.2

FOREIGN PATENT DOCUMENTS

JP 5-38779 * 2/1993 ..... 238/108

* cited by examiner

*Primary Examiner*—Lien M. Ngo
(74) *Attorney, Agent, or Firm*—Alan D. Kamrath; Nikolai & Mersereau, P.A.

(57) ABSTRACT

A gas container includes a bag, a mouth and a connector. The bag defines a space for storing gas and an aperture for passing the gas. The mouth includes a first end for connection with a valve and a second end inserted in the aperture. The connector is located between the bag and the second end of the mouth.

18 Claims, 5 Drawing Sheets

GAS CONTAINER

FIELD OF INVENTION

The present invention relates to a gas container.

BACKGROUND OF INVENTION

Referring to FIG. 1, a gas container 1 includes a bag 4 and a mouth 2. The mouth 2 is made of polyoxymethylene so as to exhibit adequate rigidity. Since polypropylene does not dissolve in alkane and prevents aluminum from oxygenation, an inmost layer 3 of the bag 4 is made of polypropylene. However, gas often leaks between the mouth 2 and the inmost layer 3 of the bag 4 because of poor connection between them.

The present invention is therefore intended to obviate or at least alleviate the problems encountered in the prior art.

SUMMARY OF INVENTION

The primary objective of the present invention is to provide a gas-tight container.

According to the present invention, a gas container includes a bag, a mouth and a connector. The bag defines a space for storing gas and an aperture for passing the gas. The mouth includes a first end for connection with a valve and a second end inserted in the aperture. The connector is located between the bag and the second end of the mouth.

BRIEF DESCRIPTION OF DRAWINGS

The present invention will be described through detailed illustration of embodiments referring to the drawings.

DETAILED DESCRIPTION OF EMBODIMENTS

Figure 1:
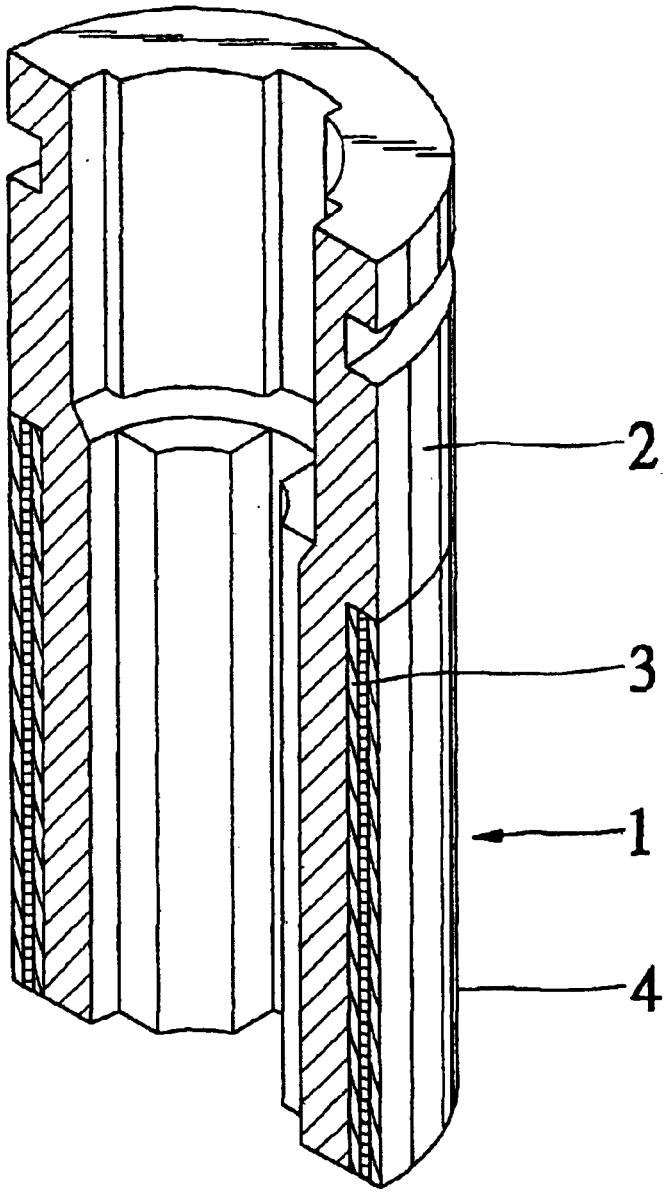
Fig. 1 PRIOR ART
FIG. 1 is a cutaway view of a conventional gas container.
Figure 2:
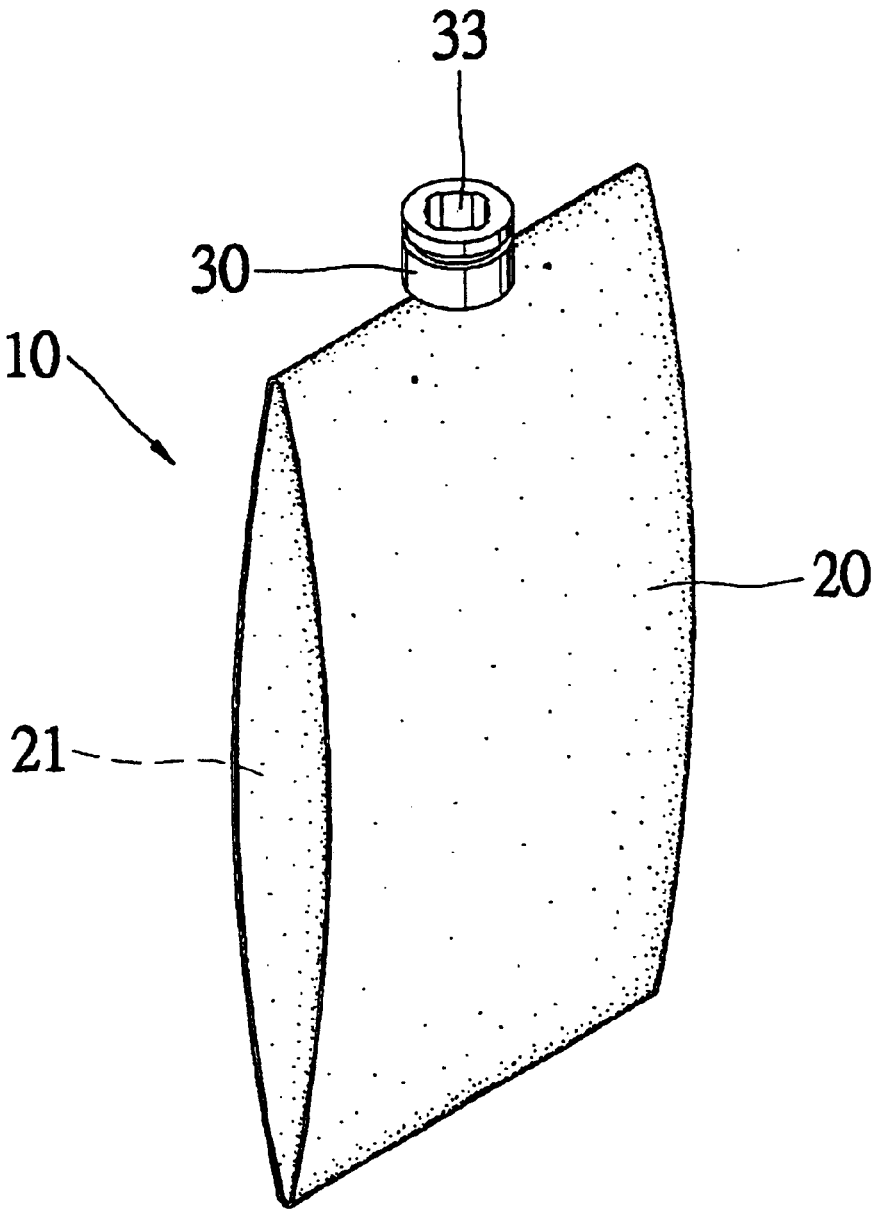
FIG. 2 is a perspective view of a gas container according to a first embodiment of the present invention.
Figure 3:
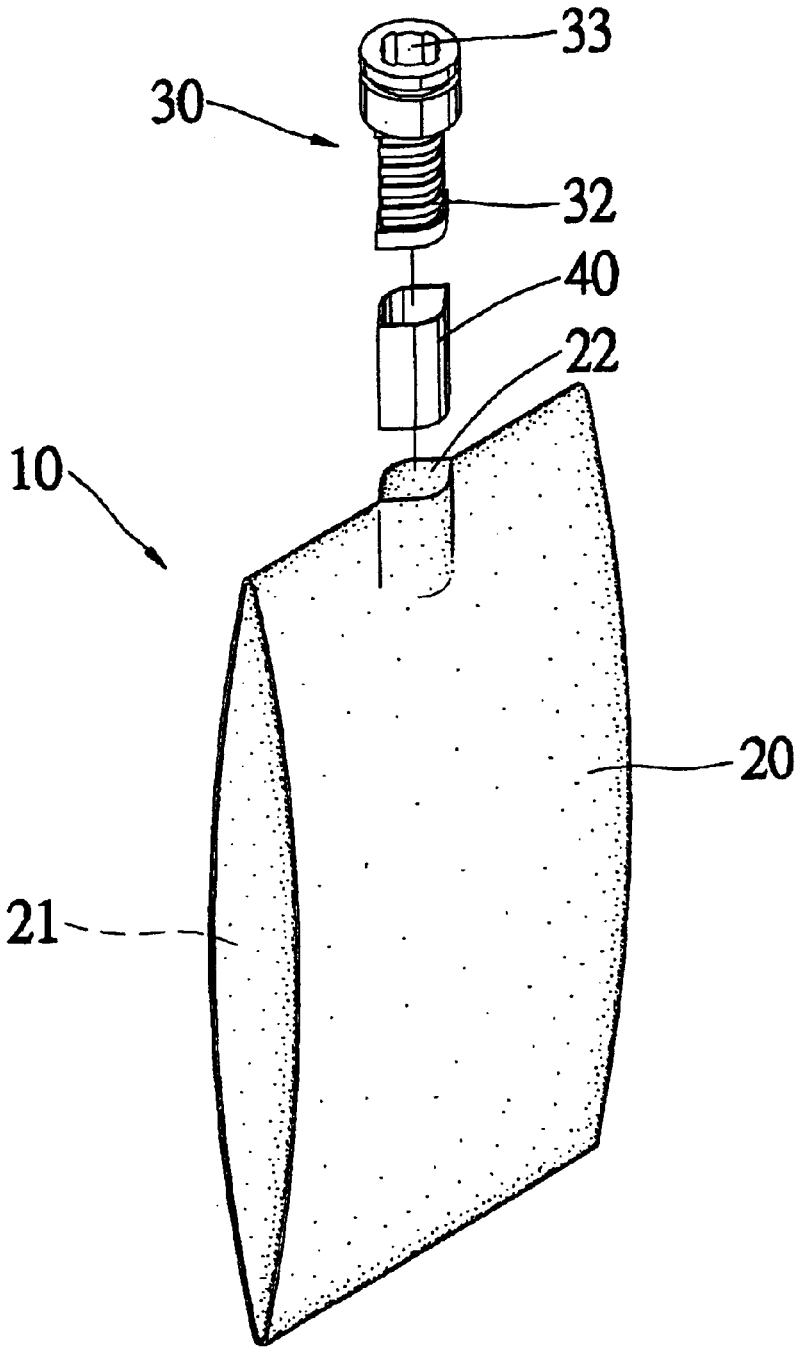
FIG. 3 is an exploded view of the gas container of FIG. 2.
Figure 4:
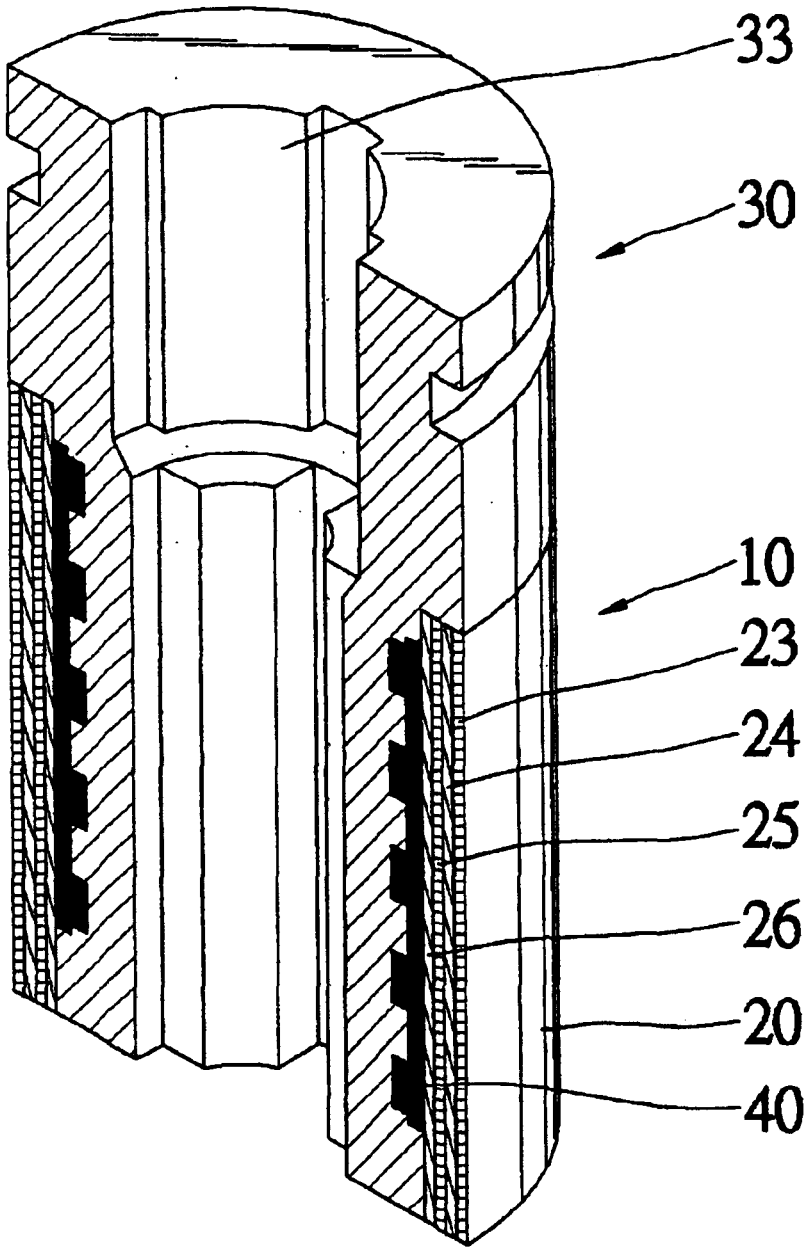
FIG. 4 is a cutaway view of the gas container of FIG. 2.

Referring to FIGS. 2~4, according to a first embodiment of the present invention, a gas container 10 includes a bag 20, a mouth 30 and a connector 40.

Referring to FIGS. 3 and 4, the bag 20 defines a space 21 for storing gas and an aperture 22 for passing the gas. Accordingly, the aperture 22 is communicated with the space 21. The bag 20 includes a first layer 23 ("outmost layer"), a second layer 24, a third layer 25 and a fourth layer 26 ("inmost layer"). The first layer 23 is made of polyethylene terephthalate, which is adequately waterproof. The second layer 24 is made of aluminum that provides adequate strength. The third layer 25 is made of polyamide that provides adequate tenacity and absorbs water. The fourth layer 26 is made of polypropylene. The polypropylene does not dissolve in alkane and prevents the second layer 24 made of aluminum from oxygenation.

The mouth 30 is made of polyoxymethylene. The mouth 30 includes a first end and a second end. A valve (not shown) is installed in the first end of the mouth 30. The second end of the mouth 30 is inserted in the aperture 22 of the bag 20. A plurality of ribs 32 is formed on the second end of the mouth 30. An aperture 33 is axially defined in the mouth 30.

The connector 40 is located between the inmost layer 26 of the bag 20 and the second end of the mouth 30. The connector 40 is made of polyamide. Polyamide and polypropylene can be bounded together tightly when they are subjected to heat. Polyamide and polyoxymethylene can be bounded together tightly when they are subjected to heat. Hence, the connector 40 forms a good connection between the inmost layer 26 of the bag 20 and the second end of the mouth 30 after they are heat pressed. Furthermore, the ribs 32 enhance the gas-tight connection of the mouth 30 with the connector 40.

Figure 5:
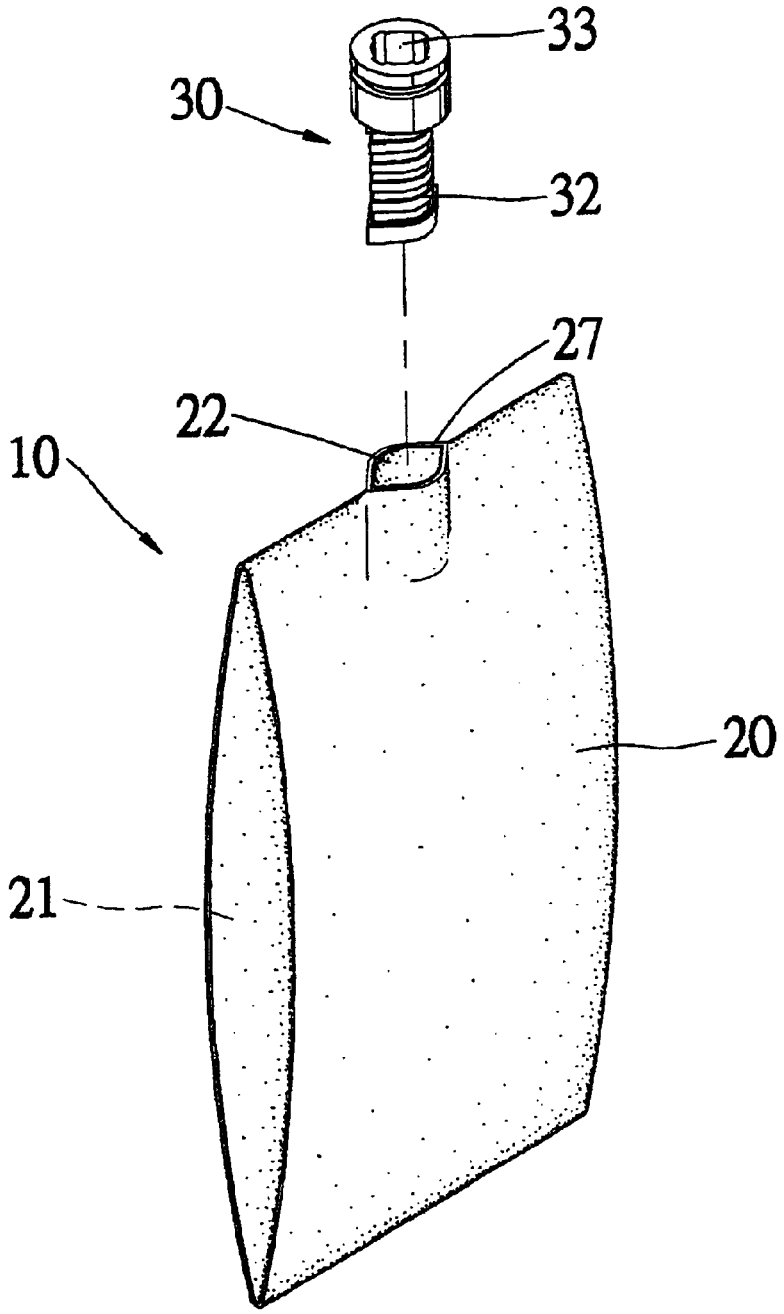
FIG. 5 is an exploded view of a gas container according to a second embodiment of the present invention.

FIG. 5 shows a gas container according to a second embodiment of the present invention. The second embodiment is identical to the first embodiment except that the connector 40 is replaced with a fifth layer 27 ("inmost layer") of the bag 20. The fifth layer 27 is made of polyamide.

The present invention has been described through detailed illustration of two embodiments. Those skilled in the art can derive variations from the embodiments without departing from the scope of the present invention. Therefore, the embodiments shall not limit the scope of the present invention defined in the claims.

What is claimed is:

1. A gas container including:

a bag defining a space for storing gas and an aperture for passing the gas;

a mouth including a first end for connection with a valve and a second end inserted in the aperture; and a connector located between the bag and the second end of the mouth, wherein the bag includes a lining of polypropylene, and the mouth is made of polyoxymethylene, and the connector is made of polyamide so that the lining of the bag, the second end of the mouth and the connector are bounded together firmly when they are subjected to heat pressing.

2. A gas container including:

a bag defining a space for storing gas and an aperture for passing the gas;

a mouth including a first end for connection with a valve and a second end inserted in the aperture; and a connector located between the bag and the second end of the mouth, wherein the mouth includes a plurality of protrusions formed on the second end.

3. The gas container according to claim 2 wherein the protrusions are annular ribs.

4. The gas container according to claim 3 wherein the bag includes a first layer of polyethylene terephthalate.

5. The gas container according to claim 4 wherein the bag includes a second layer of aluminum attached to an internal side of the first layer.

6. A gas container including:

a bag defining a space for storing gas and an aperture for passing the gas;

a mouth including a first end for connection with a valve and a second end inserted in the aperture; and a connector located between the bag and the second end of the mouth, wherein the bag includes a first layer of polyethylene terephthalate, wherein the bag includes a second layer of aluminum attached to an internal side of the first layer, wherein the bag includes a third layer of polyamide and attached to an internal side of the second layer.

7. The gas container according to claim 6 wherein the bag includes a fourth layer of polypropylene attached to an internal side of the third layer.

8. A gas container including:

a bag defining a space for storing gas and an aperture for passing of the gas, the bag including a lining of polyamide; and a mouth including a first end for connection with a valve and a second end inserted in the aperture, the mouth being made of polyoxymethylene so that the lining of the bag and the second end of the mouth are bounded together firmly when they are subjected to heat pressing.

9. The gas container according to claim 8 wherein the mouth includes a plurality of protrusions formed on the second end.

10. The gas container according to claim 9 wherein the protrusions are annular ribs.

11. The gas container according to claim 8 wherein the bag includes a layer of polypropylene and attached to an external side of the lining.

12. The gas container according to claim 11 wherein the bag includes a layer of polyamide attached to an external side of the layer of polypropylene.

13. The gas container according to claim 12 wherein the bag includes a layer of aluminum attached to an external side of the layer of polyamide.

14. The gas container according to claim 13 wherein the bag includes a layer of polyethylene terephthalate attached to an external side of the layer of aluminum.

15. The gas container according to claim 1 wherein the bag includes a first layer of polyethylene terephthalate.

16. The gas container according to claim 15 wherein the bag includes a second layer of aluminum attached to an internal side of the first layer.

17. The gas container according to claim 2 wherein the bag includes a first layer of polyethylene terephthalate.

18. The gas container according to claim 17 wherein the bag includes a second layer of aluminum attached to an internal side of the first layer.

* * * * *